United States Patent [19]

Yasuda

[11] Patent Number: 4,616,774

[45] Date of Patent: Oct. 14, 1986

[54] STAPLER

[75] Inventor: Yasuo Yasuda, Tokyo, Japan

[73] Assignee: Plus Corporation, Tokyo, Japan

[21] Appl. No.: 706,000

[22] Filed: Feb. 27, 1985

[30] Foreign Application Priority Data

Mar. 1, 1984 [JP] Japan ..... 59-29549[U]
Aug. 1, 1984 [JP] Japan ..... 59-118713[U]

[51] Int. Cl.[4] ..... B25C 5/02
[52] U.S. Cl. ..... 227/113
[58] Field of Search ..... 227/113, 120

[56] References Cited

U.S. PATENT DOCUMENTS 4,424,929 1/1984 Weis ..... 227/113 X

FOREIGN PATENT DOCUMENTS 2850316 1/1979 Fed. Rep. of Germany ..... 227/113

*Primary Examiner*—Paul A. Bell
*Attorney, Agent, or Firm*—Koda and Androlia

[57] ABSTRACT

A stapler including a base frame, a staple magazine, and a handle frame with a staple ejector which are coupled together for pivotal movement. A magnet is fixed at the front end of the staple magazine such that the magnet is interposed between the upper yoke and the lower yoke and an adhesive agent is applied around the yokes. By means of this structure, the magnet can be tightly and securely held at the front end of the staple magazine and prevented from coming off.

1 Claim, 4 Drawing Figures

STAPLER

BACKGROUND OF THE INVENTION

1. Field of the Invention

This invention relates to a stapler, and more particularly to a stapler with a magnet which retains staples in a staple magazine.

2. Prior Art

A regular stapler includes a base, a staple magazine, and a handle which are hinged for pivotal motion and wherein staples are pushed forward by a spring. Other types of stapler employ a magnet which has a similar function as a spring. The magnet draws the staples beneath the staple ejector provided on the handle. In this type of stapler, the magnet must be securely attached to the stapler; however, occasionally the magnet occasionally comes off of the stapler, causing the stapler to stop functioning stapling operation.

SUMMARY OF THE INVENTION

Therefore, the primary object of this invention is to provide a stapler with an improvement in the magnet retaining structure.

Another object of this invention is to provide a stapler with an improvement in the magnet retaining structure which prevents the magnet from coming off of the magnet holding section.

In keeping with the principles of this invention, the objects of this invention are accomplished by the unique structure of the stapler which includes a base, a stapler magazine, and a handle which are coupled to make a pivotal motion and a magnet is fixed at the front end of the staple magazine interposed by upper and lower yokes securely.

BRIEF DESCRIPTION OF THE DRAWINGS

The above mentioned features and objects of this invention will become more apparent with reference to the following description taken in conjunction with the accompanying drawings wherein like reference numerals denote like elements and in which.

DETAILED DESCRIPTION OF THE INVENTION

Figure 1:
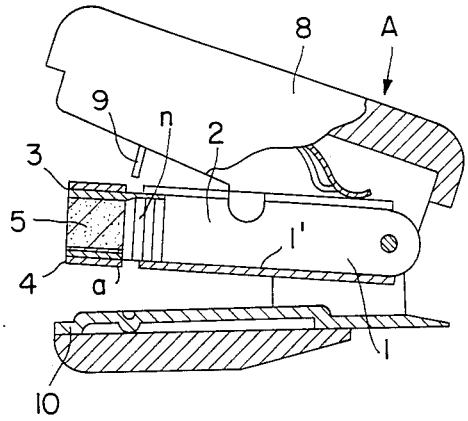
FIG. 1 is a partial cross sectional side view of the stapler of this invention.
Figure 2:
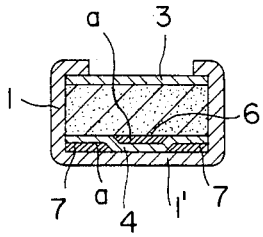
FIG. 2 is a front view of the magnet retaining section of the stapler.
Figure 3:
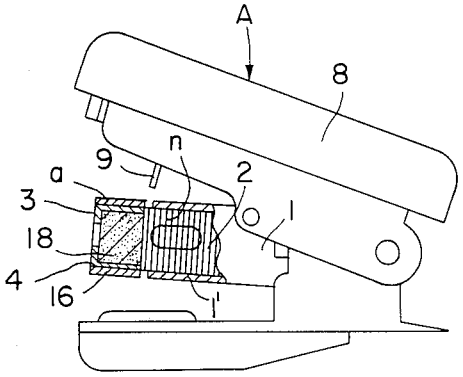
FIG. 3 is a partial cross section side view of a stapler in accordance with the second embodiment of this invention.

FIGS. 1 and 2 show a stapler A of the first embodiment of this invention. The stapler A includes a staple magazine 1, a handle frame 8, and a base frame 10 which are coupled at the rear ends to make a pivotal motion around hinge pin.

The staple magazine 1 is formed into an angled letter C-shape in cross section, and a bar of staples n is loaded in the inside 2 of the staple magazine 1. The front open end of the staple magazine 1 is a magnet retaining section, and a magnet 5 is placed in this magnet retaining section. The magnet 5 in the retaining section is interposed between an upper yoke 3 and a lower yoke 4.

The lower yoke 4 is formed into substantially a wave shape by bending both sides of a flat plate slightly in the same direction, i.e. in the upward direction of the Figure. In other words, the lower yoke 4 is formed such that the both sides of the flat plate are raised slightly higher than the center portion of the plate. Thus, when the magnet 5 is placed in the magnet retaining section with the upper and lower yokes 4 and 5, a gap 6 is formed between the lower yoke 4 and the magnet 6, and gaps 7 are formed between the lower yoke 4 and the bottom 1' of the staple magazine 1. An adhesive agent a is applied to the gaps 6 and 7 for more securely retaining the magnet 5.

In FIG. 1, the reference numeral 9 is a staple driver provided at the front end of the handle frame 8. The stapler A is designed such that the staples n are loaded into the staple magazine 1 from the open rear end thereof, and the magnet 5 draws the staples forward and retains them in the staple magazine 1.

In this embodiment, the lower yoke 4 is bent so that the gaps for the adhesive agent are formed between the magnet 5 and the staple magazine 1. The same result may be obtained when the upper yoke 3 is bent into a wave-shape so that gaps will be formed between the magnet and the upper yoke and between the upper yoke and the staple magazine. Also, both the upper and lower yokes 3 and 4 can be bent so that gaps for the adhesive agent will be formed above and below the magnet.

Figure 4:
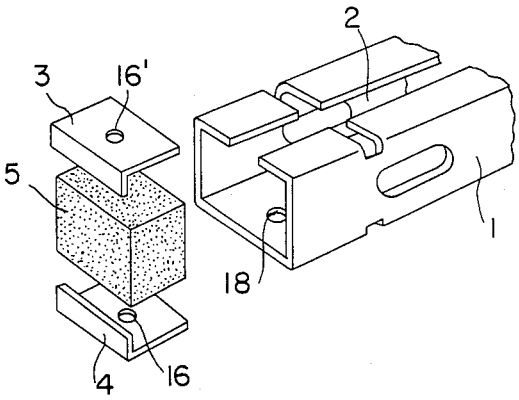
FIG. 4 is a front view of the magnet retaining section of the stapler of the second embodiment of this invention.

FIG. 4 shows the second embodiment in accordance with the present invention.

In this second embodiment, the magnet 5 is interposed between the upper yoke 3 and the lower yoke 4 which are both bent into L-shapes in cross section. The magnet 5 is placed in the open front end, a magnet retaining section, of the staple magazine 1 together with the upper and lower yokes 3 and 4 so that the magnet 5 is tightly fixed at the front end of the staple magazine 1. A projection 18 is formed on the bottom 1' of the staple magazine 1, and a through hole 16 formed on the lower yoke 4 is engaged with it.

In this embodiment, the upper and lower yokes 3 and 4 are formed of the same material, and the adhesive agent a is injected from a through hole 16' formed on the upper yoke 3. The projection 18 is formed as an embossed tag by embossing a part of the bottom 1' of the magnet magazine 1. Otherwise the structure is the same as that in the first embodiment.

As described in detail above, according to this invention, a magnet can be securely interposed and retained by upper and lower yokes at the front end of the stapler magazine. Therefore, the magnet is prevented from coming off the stapler magazine.

It should be apparent to those skilled in the art that the above-described embodiments are merely illustrative of but a few of the many possible specific embodiments which represent the applications of the principles of the present invention. Numerous and varied other arrangements can be readily devised by those skilled in the art without departing from the spirit and scope of the invention.

I claim:

1. A stapler comprising a base frame, a stapler magazine and handle frame which are coupled together for pivotal motion, wherein a magnet attracting a bar of staples is fixed at the front end of the magazine, the magnet being interposed and securely held between an upper yoke and a lower yoke, said lower yoke being bent into a substantially wave-shape in cross-section and an adhesive agent being applied in gaps between the magnet and the lower yoke and between the lower yoke and the staple magazine.

* * * * *